United States Patent [19]

Mackenroth, III et al.

[11] 4,237,558

[45] Dec. 9, 1980

[54] REMOVABLE COOLING HATBAND APPARATUS

[76] Inventors: Joseph R. Mackenroth, III, 8117 McArthur Dr., Harahan, La. 70123; Hugo B. Bode, 9555 King Crest Pkwy., Baton Rouge, La. 70810

[21] Appl. No.: 971,229

[22] Filed: Dec. 20, 1978

Related U.S. Application Data

[63] Continuation-in-part of Ser. No. 820,755, Aug. 1, 1977, Pat. No. 4,130,902, which is a continuation-in-part of Ser. No. 701,848, , abandoned.

[51] Int. Cl.[3] ..... A42C 5/02

[52] U.S. Cl. ..... 2/181; 2/181.4; 2/7

[58] Field of Search ..... 2/181, 181.2, 181.4, 2/181.6, 181.8, 182.1, 182.2, 182.3, 182.5, 171, 171.2, 7; 150/2.2, 2.1, 2.3, 2.4

[56] References Cited

U.S. PATENT DOCUMENTS

| | | | |
|---|---|---|---|
| 923,986 | 6/1909 | Morigl | 2/181.4 |
| 1,321,544 | 11/1919 | Oetting | 2/181 |
| 2,010,132 | 8/1935 | Bischoff | 2/7 X |
| 2,832,077 | 4/1958 | McGinnis | 2/171 |

FOREIGN PATENT DOCUMENTS

| | | | |
|---|---|---|---|
| 260533 | 11/1926 | United Kingdom | 2/181 |

*Primary Examiner*—Peter P. Nerbun
*Attorney, Agent, or Firm*—Keaty & Garvey

[57] ABSTRACT

A removable cooling band structure attaches directly to a hatband portion of a desired hat to be cooled. The cooling band structure has a liquid retaining pad for abutting at least a portion of the forehead of the wearer. Associated with the band structure and pad is a fluid supply vessel which is cooperatively connected to the cooling band structure and transmits fluid such as water to the band structure through a wick by capillary action.

10 Claims, 6 Drawing Figures

REMOVABLE COOLING HATBAND APPARATUS

This application is a continuation in part of U.S. application which refers to Ser. No. 820,755, Aug. 1, 1977, now U.S. Pat. No. 4,130,902 which is a continuation in part of U.S. Ser. No. 701,848, now abandoned.

BRIEF SUMMARY OF THE INVENTION

1. Field of the Invention

The present invention relates to a cooling hatband for use with an attached headwear wherein the cooling effect is acheived by the evaporative action of a cooling fluid which is dispensed continuously to the cooling hatband from a fluid supply vessel. The present invention more particularly relates to a removable temporary cooling hatband apparatus which can be easily adapted to the hatband portion of a desired hat to be cooled such as a construction hardhat.

2. General Background and Prior Art

Many situations dictate that an individual be required to wear a hat or other protective covering for the head, even when weather conditions make the wearing of the hat quite uncomfortable. For example, in the construction industry, O.S.H.A. regulations stipulate that personnel in any construction environments wear a "hardhat" or like helmet. The regulation prevents injuries and deaths as the hardhat protects the wearer's head from falling objects and like those which could prove injurious or fatal.

In very hot weather, as often occurs during the summer months, hardhats, helmets and like headwear can be quite uncomfortable when temperature increases into the 80 degree level and above.

Often these hardhats and like helmets or coverings for the head are provided with an inner hatband and other suspension and support members which actually abut the head of the wearer with the hardened outer helmet being attached to the inner suspension members.

Thus a great need exists for a cooling structure which can be added to a helmet, hardhat or the like without undue modification or expense.

3. General Discussion of the Present Invention

The present invention provides a temporary removable hatband apparatus which attaches directly in the preferred embodiment to the hatband portion of a desired hat to be cooled. The apparatus provides a cooling band structure having a liquid retaining pad for abutting at least a portion of the forehead of the wearer. Associated with the band structure and absorbent pad is a fluid supply vessel which is cooperatively connected to the cooling band structure and transmits fluid such as water to the band structure through a wick by capillary action. The band structure provides an attachment clip which can run the entire length of the band structure the attachment clip allowing attachment of the band structure easily to the hatband portion of a desired hat to be cooled.

Thus it is an object of the present invention to provide a temporary removable hatband structure which can be easily and quickly added to any conventional hatband within a desired hat to be cooled.

It is another object of the present invention to provide a simple and easy to use cooling hatband structure.

It is a further object of the present invention to provide a cooling hatband structure which is both easy and economical to manufacture.

It is a further object of the present invention to provide a cooling hatband structure where coolant flows to the absorbent pad portion of the cooling hatband by capillary action thus avoiding excessive amounts of water or like cooling fluid from flowing to the absorbent pad which abutts the forehead of the wearer.

It is another object of the present invention to provide a cooling hatband structure which attaches firmly to the hatband of the desired hat to be cooled, having an inner serrated surface to enhance gripping.

BRIEF DESCRIPTION OF THE SEVERAL VIEWS OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
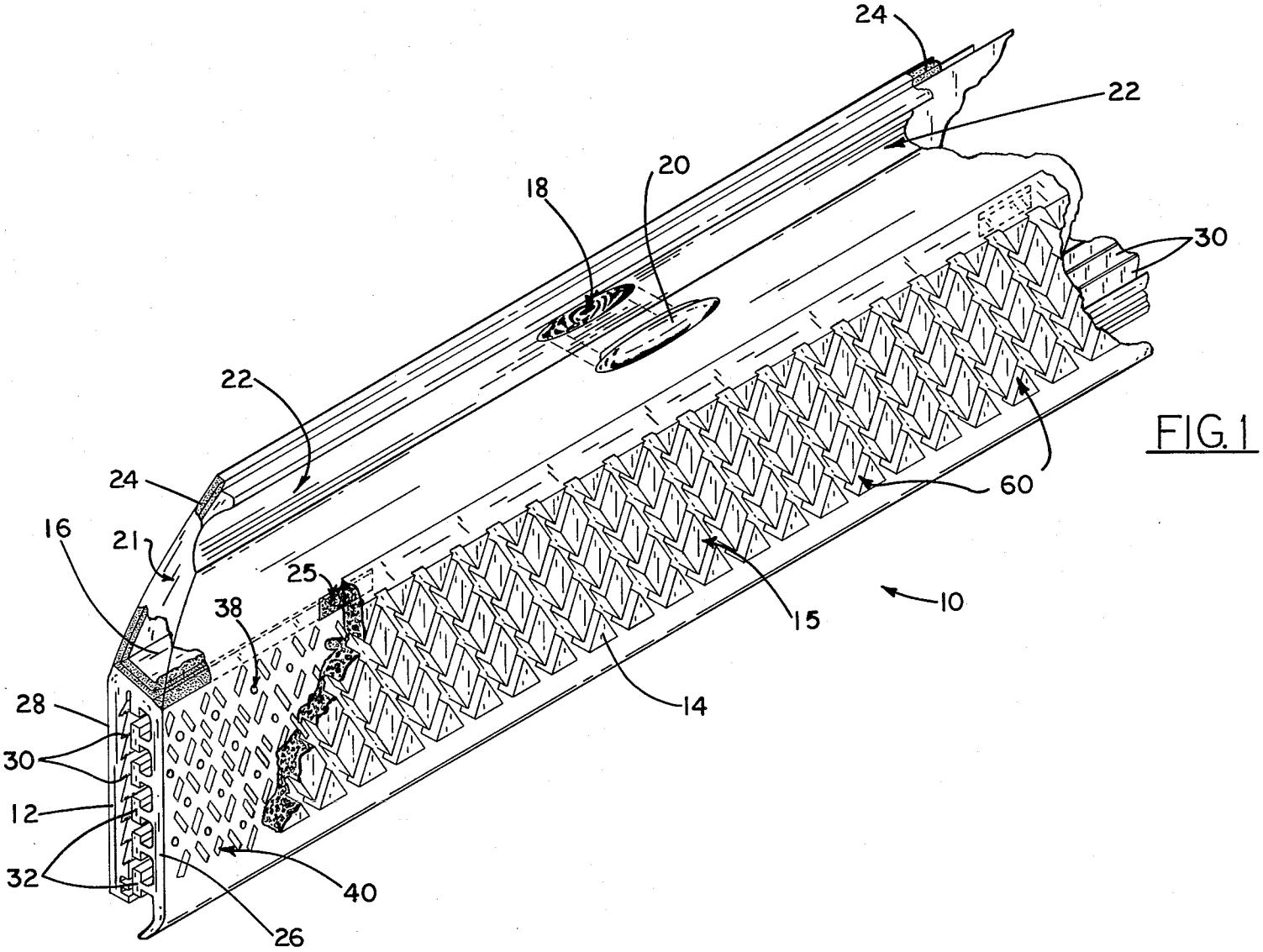
FIG. 1 is a partially broken persepective view of the preferred embodiment of the apparatus of the present invention.
Figure 2:
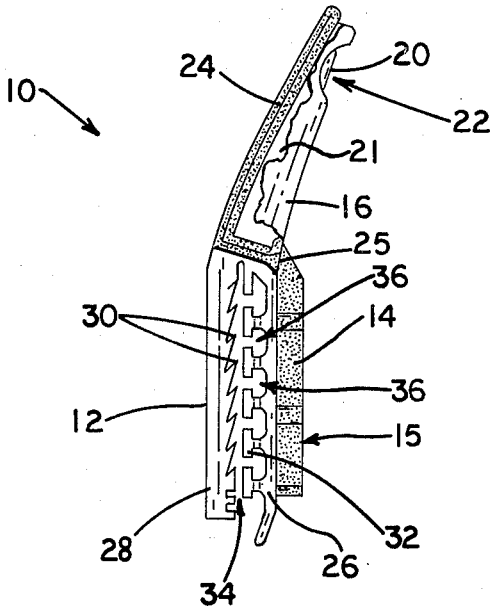
FIG. 2 is a sectional view of the preferred embodiment of the apparatus of the present invention.

FIG. 1 best illustrates the preferred embodiment of the apparatus of the present invention.

In FIG. 1 there can be seen a cooling hatband structure 10 which provides a headband clip 12 and an attached absorbent pad 14 having an inner surface 15 for abutting the forehead portion of the head of a wearer. Further shown in FIG. 1 is a fluid supply vessel 16 which provides a flow of fluid to the absorbent pad 14 by way of wick 24. Opening 18 provides a port through which water or like cooling fluid 17 can be added to supply vessel 16. An elongated funnel 22 is provided for enhancing the flow of fluid into opening 18 as is desirable. Cap 20 provides a seal for opening 18 after the desired inner fluid 17 has been added to supply vessel 16.

Figure 3:
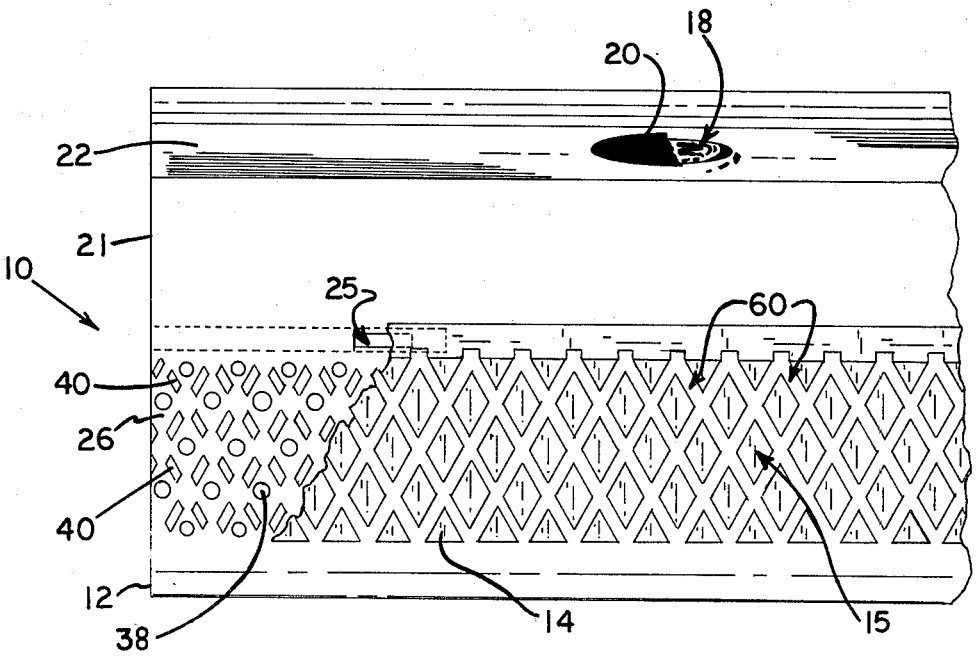
FIG. 3 is a partial broken front view of the preferred embodiment of the apparatus of the present invention.
Figure 4:
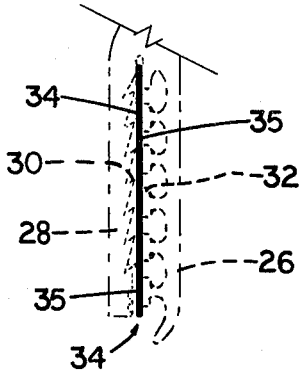
FIG. 4 is a sectional view illustrating the clip portion in phantom lines of the preferred embodiment of the apparatus of the present invention as attached to a conventional hatband.
Figure 5:
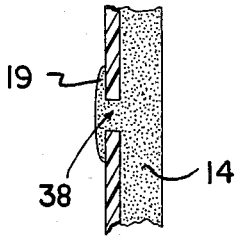
FIG. 5 is a sectional detail illustrating the attachment of the absorbent pad portion to the band structure portion of the preferred embodiment of the apparatus of the present invention; and, FIG. 6 is a partial sectional view of the preferred embodiment of the apparatus of the present invention illustrating the fluid supply vessel, the wick, and the flow of fluid to the absorbent pad by capillary action.

FIGS. 2–5 best illustrate the clip 12 portion of the preferred embodiment of the apparatus of the present invention. Clip 12 provides an inner clip member 26 which abuts absorbent pad 14 as can best be seen in FIG. 2. An outer clip member 28 having inwardly projecting serrations 30 is approximately located to inner clip member 26 with a slot 34 being provided therebetween for the insertion of the hatband portion of a hat which will be cooled. FIG. 4 illustrates the insertion of the hatband 35 of for example a construction hardhat being inserted into slot 34. Note that serrations 30 of outer clip member 28 grip hatband 35 and enhance its attachment within clip 12.

Inner clip member 26 provides a plurality of spacing ribs 32 which are substantially tee shaped. Ribs 32 as seen in FIG. 4 press against the hatband 35 portion of a conventional hat to be cooled. A plurality of air passages 36 are defined by the spaces between ribs 32. Air passages 36 allow air to pass freely along the surface of inner clip member 26 and communicate with absorbent pad 14 through openings 38, 40 as will be discussed more fully hereinafter.

Figure 6:
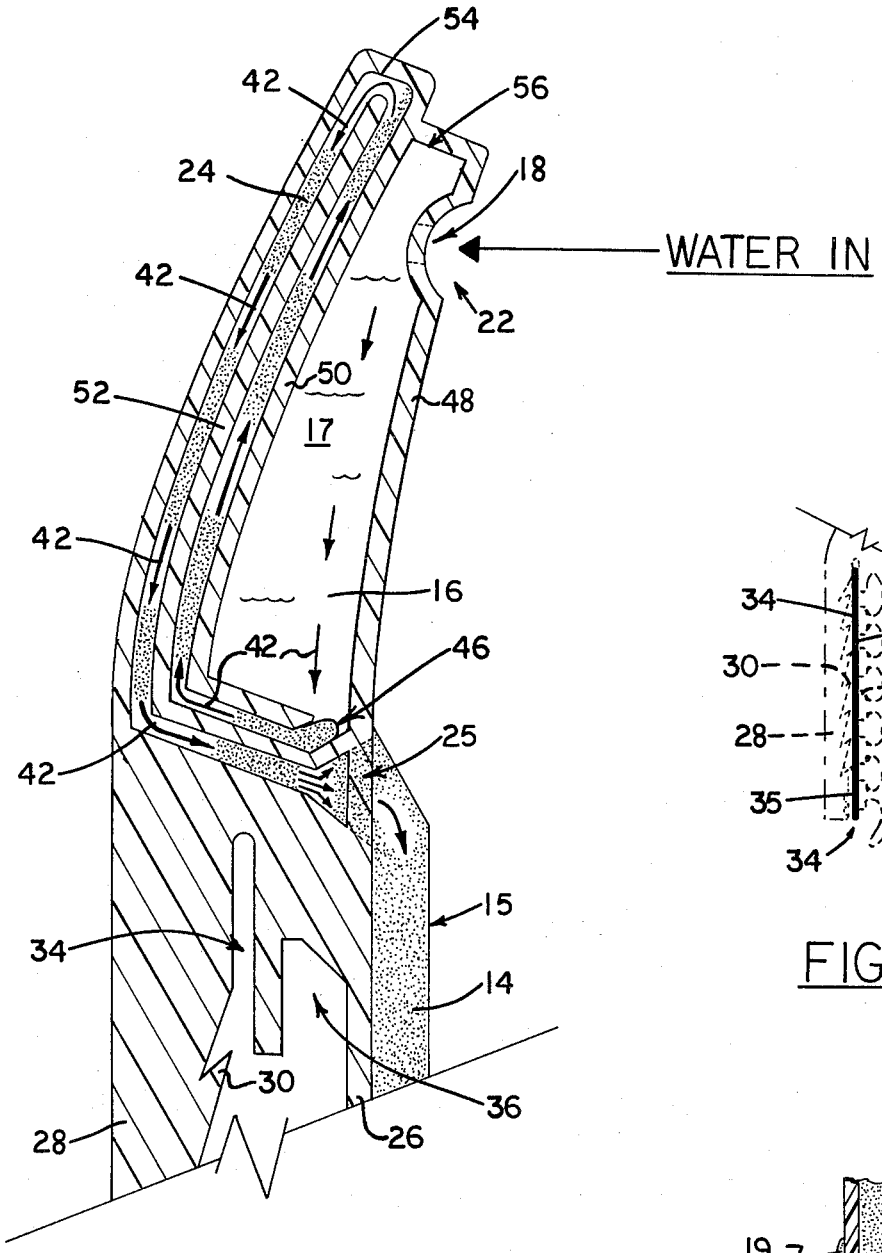

A wick 24 which is for example an absorbent foam material is provided which communicates between water supply vessel 16 and absorbent pad 14. FIG. 6 best illustrates the construction of wick 24 and its relationship with water supply vessel 17 and absorbent pad 14.

In FIG. 6 arrows 42 illustrate the normal flow of fluid such as water from water supply vessel 17 through wick 42 to absorbent pad 14. The upper tip 54 of wick 24 is placed higher than the upper level of fluid 56 in fluid supply vessel 16. It will be appreciated from the above description, that water will only flow from supply vessel 16 to absorbent pad 15 by capillary action. Thus, absorbent pad 14 will not be supplied with an inadvertently large amount of cooling fluid causing drips from absorbent pad 14 and the loss of cooling fluid 17.

The flow of fluid 17 from supply vessel 16 begins at discharge port 46 which defines the starting portion of wick 24. Fluid then moves upwardly towards upper tip 54 portion of wick 24 and then downwardly toward openings 25 to absorbent pad 15. A plurality of openings 25 can be provided through fluid vessel outer wall 48 to communicate with absorbent pad 14 as is desirable. The inner wall 50 of fluid supply vessel 16 defines also a baffle or separation between wick 24 and fluid supply vessel 16.

FIG. 3 best illustrates the construction of absorbent pad 14 and its attachment to inner clip member 26. Note that a plurality of circular 38 and diagonal 40 openings are provided through inner clip member 26 of headband clip 12. Absorbent pad 14 as can best be seen in FIG. 5 can be foam which is injected to inner clip member 26 through openings 38 to produce a connective button 19. Also, button 19 would communicate with the air flowing through air passages 38 between ribs 32.

Absorbent pad 14 provides an inner surface 15 for contact with the forehead portion of the wearer. Note that diagonal passages 60 are provided on absorbent pad 14 which corresponds generally with the position of diagonal openings 40. The diagonal passages 60 would allow air to flow freely therethrough when absorbent pad 14 abuts the head of the wearer. Thus, it can be appreciated that air can flow freely through the air passages 36 defined between the spaces of ribs 32 and contact absorbent pad 14 through openings 38, 40. Likewise, air can flow freely through diagonal passages 60 of absorbent pad 14 to further enhance the evaporative cooling action.

Headband clip 12 can be manufactured of any suitable lightweight, durable material such as plastic. In the preferred embodiment, the headband clip 12, and fluid supply vessel 16 would be extruded and cut to the desired lengths. Thereafter, the end portions 21 of fluid supply vessel 16 could be sonic welded to form a fluid containing sealed supply vessel 16. Absorbent pad 14 and wick 24 could be any suitable absorbent liquid retaining material such as foam rubber or the like.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A removable cooling hatband apparatus, comprising:

a. a cooling band structure, said band structure providing a liquid retaining pad for abutting at least a portion of the forehead of a wearer;

b. a fluid supply vessel cooperatively connected to said cooling band structure and transmitting fluid to said band structure; and c. an attachment clip associated with said cooling band structure for temporarily attaching said band structure to a desired hat to be cooled, with said pad abutting the head of the wearer when so attached by said attachment clip.

2. The removable cooling hatband apparatus of claim 1 wherein said attachment clip is removably attachable, allowing said band structure to be removed after attachment to a desired hat to be cooled.

3. The removable cooling hatband apparatus of claim 1 wherein said attachment clip attaches said cooling band structure to the hatband portion of a desired hat to be cooled.

4. The removable cooling hatband apparatus of claim 1, wherein said fluid supply vessel is on said cooling band structure.

5. The cooling hatband apparatus of claim 3 wherein said clip member extends substantially the entire length of said cooling band structure.

6. The cooling hatband structure of claim 5 wherein said attachment clip comprises a pair of spaced longitudinal clip members, with one of said clip members being serrated to enhance gripping of the hatband portion of the desired hat to be cooled.

7. The cooling hatband apparatus of claim 5 wherein said liquid retaining pad attaches to one of said clip members.

8. The cooling hatband structure of claim 7 wherein said clip member abutting said liquid retaining pad provides a matrix of openings therethrough communicating in part with and allowing air to contact said absorbent pad, and spacer means for spacing said clip member from the hatband of the desired hat to be cooled, said spacer means defining at least one air passage adjacent said clip member, said air passage communicating with a portion of the matrix of openings in said clip member.

9. The cooling hatband structure of claim 1 further comprising a channeling funnel on said liquid supply means for adding fluid to said liquid supply means.

10. The cooling hatband apparatus of claim 1 wherein said cooling band structure and said fluid supply vessel are an integral structure being together temporarily attachable to the hatband portion of a desired hat to be cooled.

* * * * *